US005771993A

United States Patent [19]

Anderson et al.

[11] Patent Number: 5,771,993

[45] Date of Patent: Jun. 30, 1998

[54] SAFETY DEVICES FOR FALL RESTRAINT

[75] Inventors: Preston L. Anderson, Seneca; Allen D. Boyd; Joseph F. Gayetty, both of Franklin; Robert A. Taylor, Oil City; Ronald W. Adams, Franklin, all of Pa.

[73] Assignee: Dalloz Safety, Inc., Reading, Pa.

[21] Appl. No.: 665,088

[22] Filed: Jun. 14, 1996

[51] Int. Cl.[6] ..... A62B 1/10; A62B 35/00

[52] U.S. Cl. ..... 182/239; 182/3; 182/18; 182/237; 242/383.5; 254/267

[58] Field of Search ..... 182/239, 240, 182/236, 237, 238, 71, 72, 75, 234, 3, 18; 254/376, 267, 274; 242/382.1, 383, 383.5, 396.4

[56] References Cited

U.S. PATENT DOCUMENTS

| | | | |
|---|---|---|---|
| 2,791,397 | 5/1957 | Coffman | 182/239 |
| 2,990,131 | 6/1961 | Carlsson | 182/239 X |
| 3,760,910 | 9/1973 | Koshihara | 182/237 X |
| 4,228,970 | 10/1980 | Morinaga | 242/383.5 |
| 4,253,544 | 3/1981 | Dalmaso | 182/18 X |
| 4,877,110 | 10/1989 | Wolner | 182/18 X |
| 5,351,906 | 10/1994 | Feathers | 254/267 X |

FOREIGN PATENT DOCUMENTS

| | | | |
|---|---|---|---|
| 406031008 | 2/1994 | Japan | 242/383.5 |

*Primary Examiner*—Alvin C. Chin-Shue
*Assistant Examiner*—Long Dinh Phan
*Attorney, Agent, or Firm*—Bartony Hare & Edson

[57] ABSTRACT

The present invention provides a retractable lifeline safety device in which the side of the housing thereof comprises at least two extruded metal housing member which are connected to form the side of the housing. The present invention also provides a retractable lifeline safety device comprising a roller disposed in housing to reduce friction and abrasion. The present invention further provides a retractable lifeline safety device comprising a pawl clip means for maintaining the pawl adjacent the drum flange. The present invention also provides a ratchet brake assembly comprising abutment means extending radially outward therefrom to abut the housing and prevent rotation of the ratchet brake assembly relative to the housing. The present invention also provides retractable lifeline safety device comprising a drum assembly in which the drum flanges are removable from the drum hub to facilitate changes in the lifeline type. Finally, the present invention provides a lifeline comprising an indicator flag over which a portion of the lifeline is folded. When the lifeline experiences a tensile load at or above a predetermined tensile load the folded portion of the lifeline unfolds to expose the indicator flag.

10 Claims, 10 Drawing Sheets

105
115
150
151
152
153
160
165
170
140
P
120
125
232
234

110
125
130
135
141
148
158

200
240
212
230
242
215
255
165
170
153
160
152
140
110
115
140
P
152
180
105
175
125
120
212
215
245
230
235
220
245
225
210
235
240
250

400
360
370
350
340
330
330'
340'
460
460
460
460
440
450
310
320
497
470
497

300
360
370
350
320
410
440
420
430

360
370
492
494
100
490
485
212
400
496
230
200
260
430

SAFETY DEVICES FOR FALL RESTRAINT

FIELD OF THE INVENTION

The present invention relates generally to safety devices, and, more particularly to safety devices used for restraint of a fall.

BACKGROUND OF THE INVENTION

Over the years a number of devices have been developed in an attempt to minimize the injury of a worker falling from a substantial height. In particular, a number of devices (known alternatively as self retracting lifelines, self retracting lanyards, fall arrest blocks, etc.) have been developed that limit a worker's free fall distance to a specified distance and employ a friction device to limit fall arresting forces to a specified amount.

In general, all self retracting lifeline safety devices comprise a number of common components. Typically, a housing or cover provides enclosure/protection for the internally housed components thereof. The housing also provides means for anchoring the self retracting lifeline to either the user or to a fixed anchor point. The anchor means must be capable of withstanding forces necessary to stop a falling body of a given mass in a given distance.

A drum or spool around which a lifeline is spooled rotates within the housing. The drum is under adequate rotational tension (generally provided by a spring as discussed below) to reel up excess extended lifeline without hindering the mobility of the user. Like the anchor means and the other operative components of the retractable lifeline safety device, the drum must be capable of withstanding forces necessary to stop a falling body of a given mass in a given distance. The spring used to provide rotational tension to the drum is often constructed from flat spring steel or stainless steel wound into a spiral with attachment points at either end. The sole purpose of the spring is to provide rotational tension to the drum sufficient to reel up or retract excess extended lifeline. The lanyard or lifeline is attached at one end thereof to the drum to allow the drum to reel in excess lifeline. The lifeline is attached at the other end thereof to either the user or an anchorage point, whichever is not already attached to the housing.

Self retracting lifelines also generally comprise a braking system designed to allow the drum to rotate substantially freely under normal movement. At a predetermined line speed in the outward or extending direction (or, equivalently, at a predetermined angular drum velocity in the extending direction), however, the braking system creates either a rigid or dampened connection between the housing and the drum which stops the outward movement (that is, the free fall) within a given distance. The braking system is designed to release the drum when the mass is removed allowing the drum to take up excess lifeline.

A number of significant drawbacks exist with current retractable lifelines, however. For example, the housings for a number of current retractable lifelines are fabricated via extrusion of a single, integral metal housing component. Injection molded plastic bushings are typically used where the lifeline exits the housing. Because of inherent limitations upon the lower limit of the size of an opening that can be formed in an extruded integral metal housing, these plastic bushings must be relatively large, resulting in very high tooling costs. Furthermore, the overall size of an integral extruded metal housing is severely limited as a result of inherent limitations in the extrusion process. Two-piece, cast aluminum designs of housings have been developed, but such housing are very heavy and thus cumbersome to the user. Two piece injection molded housings have been fabricated to be very light in weight, but such units are extremely expensive to manufacture. In these two-piece designs, each of the two components generally extends over the entire circumference of the housing, and the two components are sealed together to form the side or circumference of a housing with an axially central seam therein.

Furthermore, the braking systems of all current retractable lifelines include a small device commonly referred to as a pawl. The pawl is generally attached to a drum flange and located off center of the rotatable drum so that the center of gravity of the pawl is off center with its axis of rotation. The pawl is biased such that at a predetermined angular velocity the pawl pivots to engage a brake mechanism and stop or dampen rotation of the drum. The pawl is typically captured against a drum flange to keep the pawl from disconnecting from the drum and creating an unreliable or unsafe condition. In most current devices the pawl is attached to the drum flange from the side of the drum flange opposite the side upon which the pawl is mounted. In such a design, either the pawl or the means used to attach the pawl may protrude through the drum flange to potentially hinder the action of the lifeline. Alternatively, the drum flange must be thick enough to allow an opening therein of sufficient size to accommodate these components. Use of such a thick drum flange, however, makes the drum heavier and increases the overall thickness of the drum, thereby requiring the housing to be larger and increasing the weight and cost of the final assembly.

In a number of other retractable lifeline safety devices, the pawl is not securely attached or fastened to the drum flange, but a portion of the pawl is seated within a bore in the drum flange such that the pawl may pivot about that portion. In this design, the tolerances of the housing and other components must be quite strict so that the pawl does not disengage from the flange when the device is placed in various positions. In many cases, however, the pawl can move or rotate out of plane with the flange, giving rise to excessive noise (sometime referred to as "chatter") in operation and to an increased risk that the break mechanism will jam.

Most current retractable safety lifeline devices also include some means for indicating if the device has been exposed to fall arresting forces. Safety devices that have been exposed to fall arresting forces are typically removed from service and either discarded or recertified, depending, in part, upon the pertinent regulations. In a number of current devices, folds are incorporated into the lifeline material that, when activated, expose a message ink-stamped into the lifeline material. There are also a number of devices that are attached to the end of the lifeline that show some sort of indicator (for example, a colored mark) when activated. In other devices, the housing may be provided with an indicator such as a button that protrudes from the housing when activated. In each of these devices, the indicator can easily be overlooked by the user or an inspector. In one device, a clearly visible "flag" indicator is fixed to a tube jacket which is in turn fixed to a tensile load bearing core having a predetermined yield strength. The flag is freed from the jacket when the lifeline is subjected to a tensile load greater than the predetermined yield strength. Although that mechanism works quite well, the structure thereof is rather complex.

Other drawbacks associated with current self retracting lifelines include: (i) expensive component changes necessary to switch lifeline types, and (ii) retraction and winding onto the drum of twisted lifeline in the case of lifelines having a rectangular cross-section.

It is very desirable to develop safety devices for fall restraint that minimize or eliminate the above drawbacks and other drawbacks associated with current devices for fall restraint.

SUMMARY OF THE INVENTION

The present invention provides a retractable lifeline safety device for protecting workers exposed to a fall hazard. The safety device comprises generally a housing for enclosing and protecting the components of the safety device. A drum assembly is rotatably mounted within the housing. The drum assembly preferably comprises a first drum flange and a second drum flange spaced generally parallel from the first drum flange. A drum hub is centrally connected between the first drum flange and the second drum flange. The safety device further comprises a lifeline having a first end attached to the drum hub and a second end extending outside the housing and adapted to be connected to an article outside the housing. The lifeline is wound around the drum hub when the drum hub is rotated in a retracting direction and unwound from the drum hub when the drum hub is rotated in an extending direction opposite the retracting direction. The safety device also preferably comprises means for biasing the drum hub to rotate in the retracting direction and means for braking extending rotation of the drum hub upon the extending rotation reaching a predetermined angular velocity.

In one embodiment, the housing comprises at least two connectable housing members. More preferably, at least three connectable housing members are provided. Each of the housing members preferably comprises a section or portion of the side or circumference of the housing. Each of the housing members preferably comprises cooperating, connection means. The housing members are preferably connected end-to-end to from the side or circumference of the housing. Preferably, the housing members are fabricated from extruded metal. Preferably, the connection means are adapted to interlock and connect the housing members together to form the sides of the housing. The multi-component extruded housings of the present invention are much more impact resistant than cast or injection molded housings. Moreover, a housing comprising a number of extruded metal housing members eliminates the need to incorporate an overly large and expensive component to close the hole at the bottom of the housing which is typically required in the case of the semi-tubular, single-piece extruded housings currently in use. Further, the multi-component or multi-member extruded metal housings of the present invention can be fabricated in virtually any size, whereas the size of single-piece extruded metal housings is severely limited.

In another embodiment, a retractable lifeline safety device is provided in which multiple lifeline styles may be used with only minimal change of design components. In this embodiment, only an exit bushing member and, in some cases, the drum hub must be changed to accommodate different lifeline styles. Preferably, all other components in the assembly remain unchanged. To accomplish such interchangeability, the first and second drum flanges are preferably removable from attachment with the drum hub. Although the use of a single drum design with a number of lifeline types is possible, in the case of stiff materials such as wire rope, the drum hub diameter is preferably increased. In general, larger drum hubs are preferable for cable to accommodate the larger bend radius of such materials. Moreover, cable does not require as much space for spooling per unit length as does webbing. The present invention, by minimizing the number of components to be changed in changing lifeline type, greatly reduces both manufacturing and inventory costs.

In another embodiment of the present invention for use with a wide and flat (that is, of generally rectangular cross-section), flexible material such as polyester or nylon webbing, a roller is preferably added in the proximity of an opening in the housing through which the lifeline exits the housing to reduce the surfaces into which the lifeline comes into contact and thereby reduce drag of the material through the exit bushing member opening. The roller also decreases abrasion on the lifeline.

In currently available retractable lifeline devices, the opening through which the webbing lifeline passes must be relatively wide in relation to the thickness of the webbing to reduce friction and abrasion. The use of such relatively wide openings very often allows twisted webbing lifeline to enter the housing and be wound onto the drum. If the webbing is allowed to lay twisted on the drum, however, it can cause the drum to overfill and prevent retraction of all of the lifeline. Slack in the lifeline resulting from such overfilling can cause the user to free fall much farther, and, therefore, faster than the design thresholds of the retractable lifeline. In the present invention, the height of the exit member opening is preferably less than approximately twice the thickness of the webbing. Such a design prevents the webbing from passing into the housing in a twisted state. This decrease in the width of the opening is made possible by the reduction in friction and abrasion achieved by incorporation of the roller.

The present invention further provides a safety device comprising means for indicating if the retractable lifeline has been subjected to fall arresting forces for use with relatively wide, flat, flexible lifeline materials such as webbing. In that regard, a small indicator flag is preferably incorporated into the lifeline. The flag becomes clearly visible when the retractable lifeline has been exposed to fall arresting forces, thereby, notifying the user or an inspector that the unit should be removed from service for either disposal or recertification. In general, the indicating means comprise a relatively small piece of material attached to the lifeline at the free end of the lifeline. The indicator material is preferably folded so that the indicator material unfolds upon activation to be clearly visible. The lifeline is folded over the folded indicator material and attached (for example, sewn) into place. When a predetermined amount of force is applied to either end of the lifeline, the fold in the lifeline becomes detached and the indicator material is unfolded and exposed.

In another embodiment, the present invention provides a safety device in which the braking means comprises a ratchet brake assembly fixed within the housing. At least one pawl is pivotally mounted on the first drum flange and is pivotal into engagement with the ratchet brake assembly upon occurrence of a predetermined angular velocity. The pawl is maintained pivotally mounted on and adjacent to the first drum flange via a pawl clip or pawl capture means including means for maintaining the pawl generally in a plane parallel to the surface of the first drum flange. The pawl clip means is attached to the first drum flange on the same side thereof upon which the pawl is mounted. The braking means also comprises means for biasing the pawl out of engagement with the ratchet brake assembly when the angular velocity is less than the predetermined angular velocity. The pawl clip means preferably comprises a relatively thin piece of material (for example, spring metal) that is attached to the drum flange and captures the pawl between itself and the drum flange such that the pawl is pivotable with substantially no friction added as a result of the pawl clip means. Unlike current retractable lifeline safety devices in which the pawl is attached to the drum flange from the opposite side of the drum flange, the present pawl attachment means adds extremely little to the overall thickness of the final assembly, is negligible in cost and is unlikely to interfere with the extension or retraction of the lifeline. By substantially maintaining the pawl in a plane parallel to the first drum flange, the pawl clip means may also reduce wear of the pawl and extend the life of the safety device.

In still another embodiment, the present invention provides a ratchet brake assembly comprising abutment members extending in a radially outward direction therefrom. These abutment members cooperate with the housing to prevent rotation of the ratchet brake assembly with respect to the housing. The ratchet brake assembly plate in current retractable lifeline safety devices is typically attached to the housing only via attachment means such as screws or spot welds. The abutment members of the present ratchet brake assembly, on the other hand, cooperate with housing to prevent rotation of the ratchet brake assembly even if other means of attachment fail.

DETAILED DESCRIPTION OF THE INVENTION

Figures 4A, 4B:
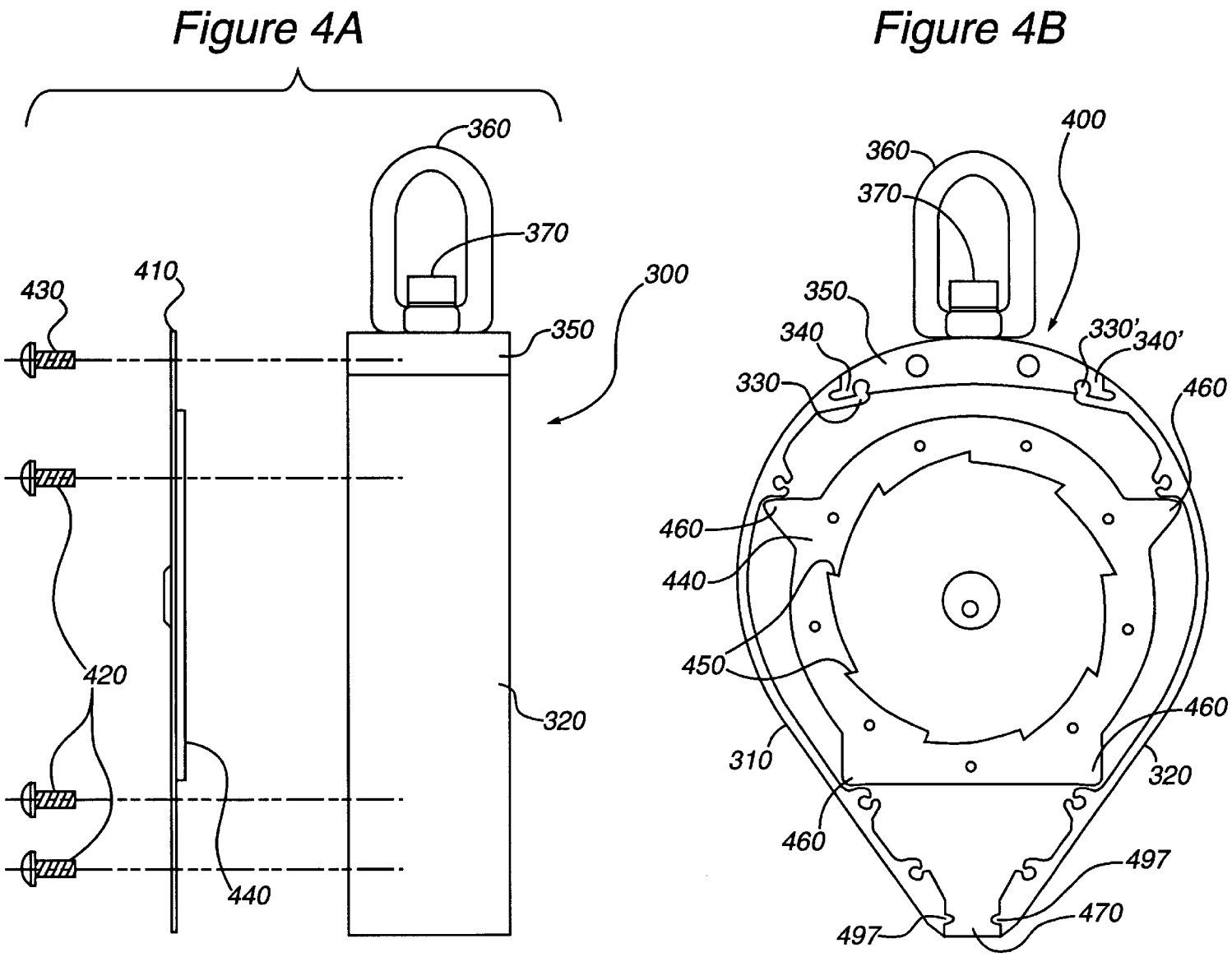
FIG. 4A illustrates a side view of the components of an embodiment of a subassembly of the housing including a rear cover prior to final assembly.
FIG. 4B illustrates a front view of the assembled subassembly of FIG. 4B.
Figures 5A, 5B:
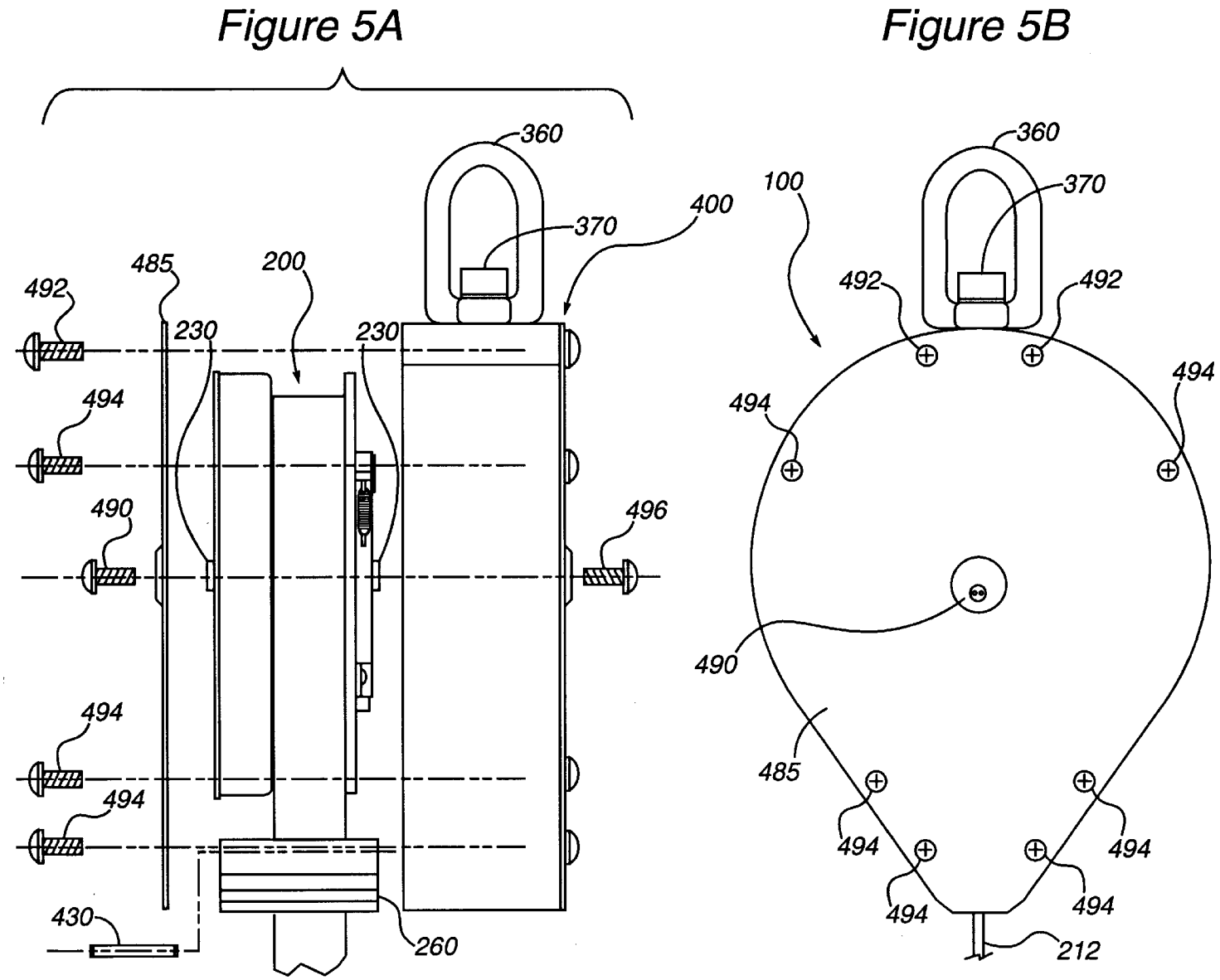
FIG. 5A illustrates a side view of the components of an embodiment of a final assembly.
FIG. 5B illustrates a front view of the assembled device of FIG. 5A.

FIGS. 1A through 5B illustrate the assembly of retractable lifeline safety device 100, a fully assembled embodiment of which is illustrated in FIG. 5B. The design and assembly of safety device 100 will be described through the discussion of the assembly of various subassemblies as illustrated in FIGS. 1A through 5A. Safety device 100 is designed for use as a self retracting lifeline that limits a worker's free fall distance to a specified distance in the event of a fall. Safety device 100 preferably incorporates a friction device to limit free fall forces experienced by the worker's body to a specified amount. As known to one skilled in the art, the components of safety device 100 must be fabricated from materials suitable to withstand forces generated during a free fall or as set forth by pertinent regulations.

Figures 1A, 1B:
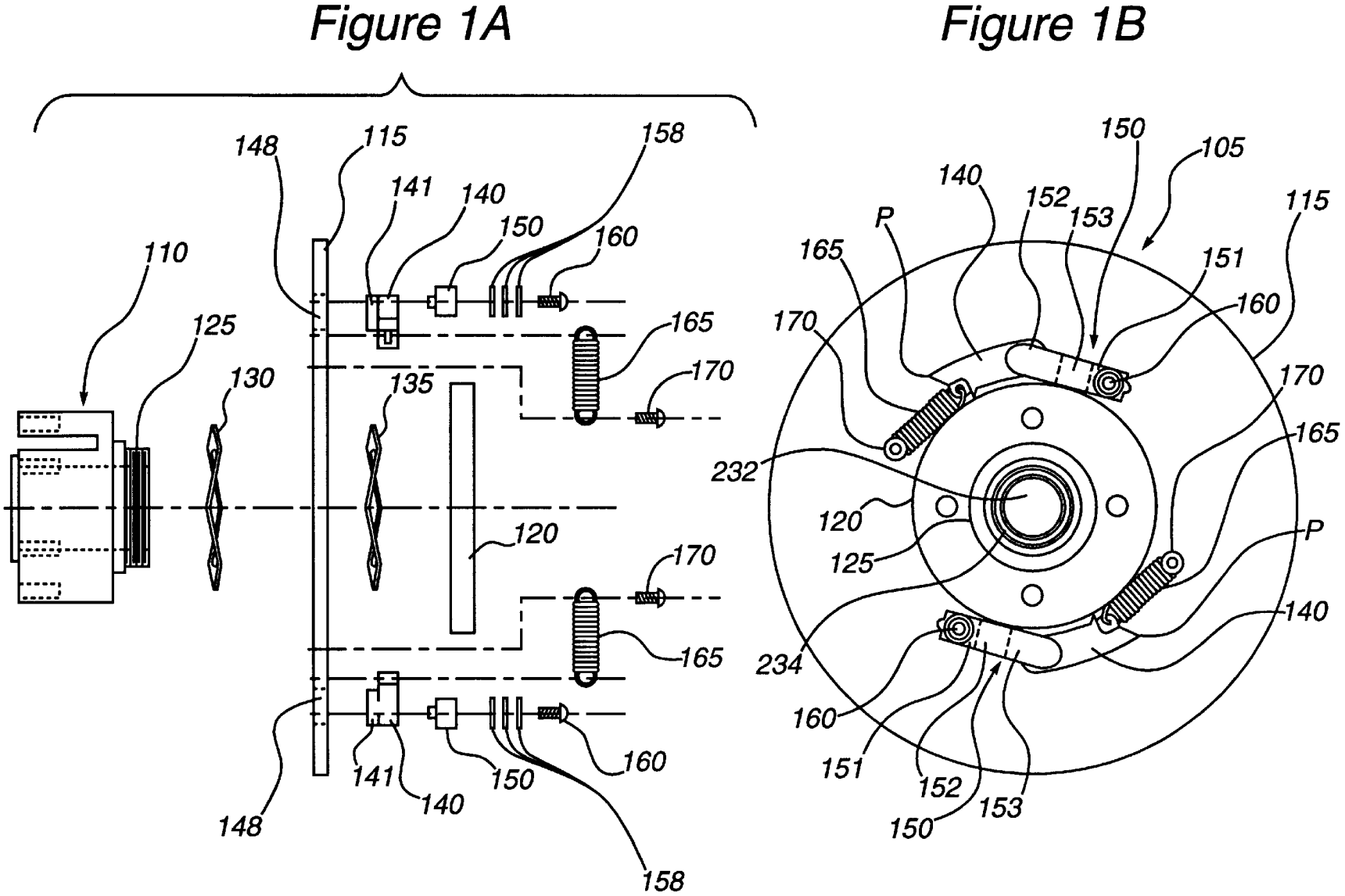
FIG. 1A illustrates schematically a side view of the components of an embodiment of a partial subassembly of a drum with brake components and a drum hub.
FIG. 1B illustrates a front view of the partial subassembly of FIG. 1A.

FIGS. 1A and 1B illustrate a partial drum subassembly 105 comprising a drum hub 110 and components of a braking system. Drum hub 110 (best illustrated in FIGS. 1A through 2A) is designed for use with lifeline of a rectangular cross-section (for example, webbing). As clear to one skilled in the art, however, the present invention is suitable for use with many types of lifelines. Drum hub 110 is preferably attached to a flange 115 using a nut 120 which cooperates with a threaded portion 125 of drum hub 110. Drum hub 110 and flange 115 are preferably appropriately spaced using washers 130 and 135. The torque applied to nut 120 predetermines the force required to rotate flange 115 with respect to drum hub 110. In one embodiment, the torque applied to nut 120 was approximately 75 foot pounds. Nut 120 may or may not be locked to drum hub 110. At least one brake pawl 140, and preferably at least two brake pawls 140 as illustrated in FIGS. 1A through 1D, are preferably pivotally or rotatably mounted upon (and in adjacent contact with) flange 115. There are preferably two brake pawl assemblies provided to decrease the chance of failure. Brake pawl(s) 140 are preferably pivotal substantially only in a plane parallel to the plane defined by flange 115. A generally cylindrical pivot member 141 extending from the pawl 140 is preferably seated in a bore 148 through flange 115. Bore 148 is preferably slightly larger in diameter than pivot member 141 to allow substantially free pivoting of pawl 140 about pivot member 141.

Figure 1C:
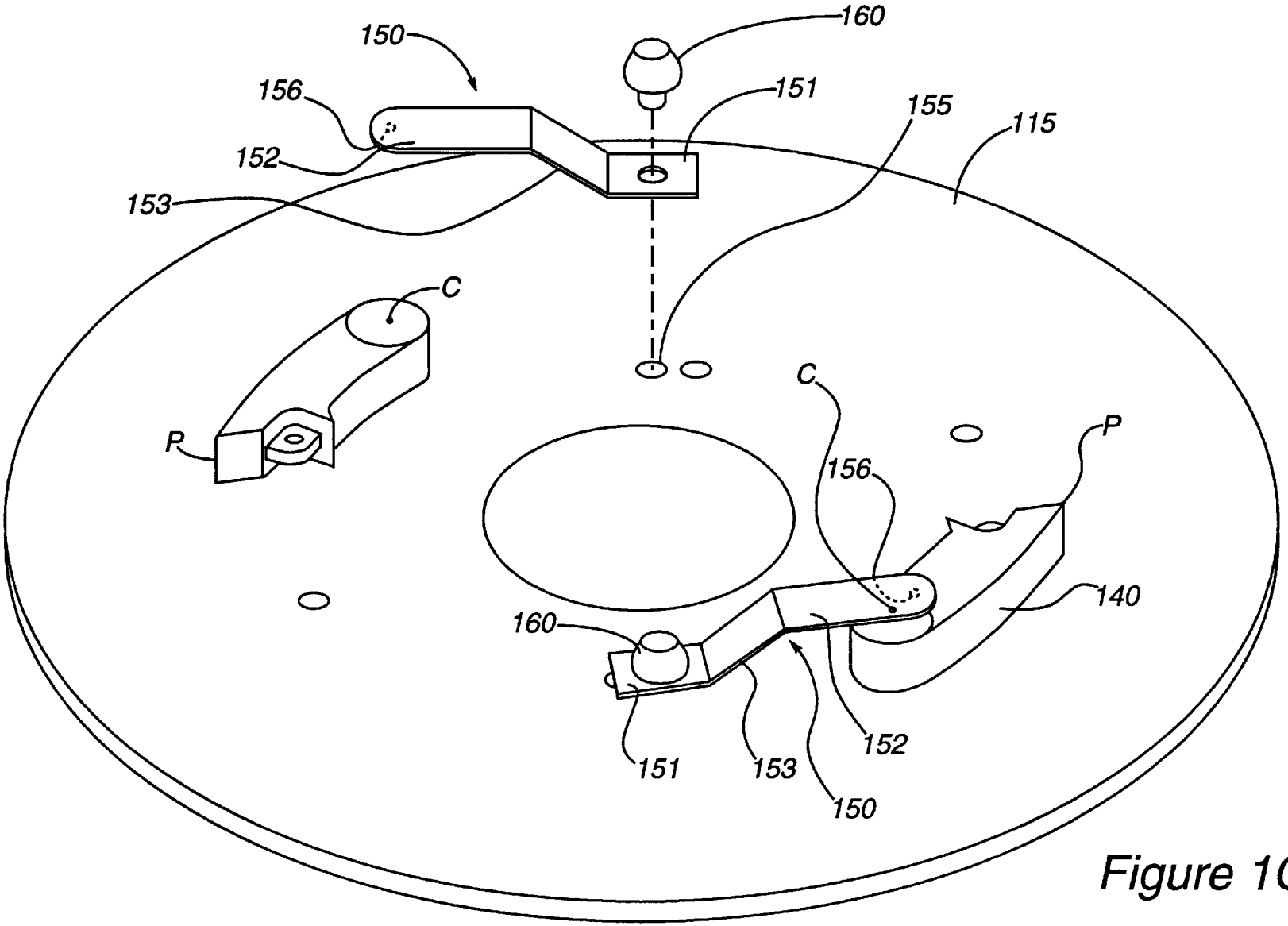
FIG. 1C illustrates an elevational view of an embodiment of a pawl clip.
Figure 1D:
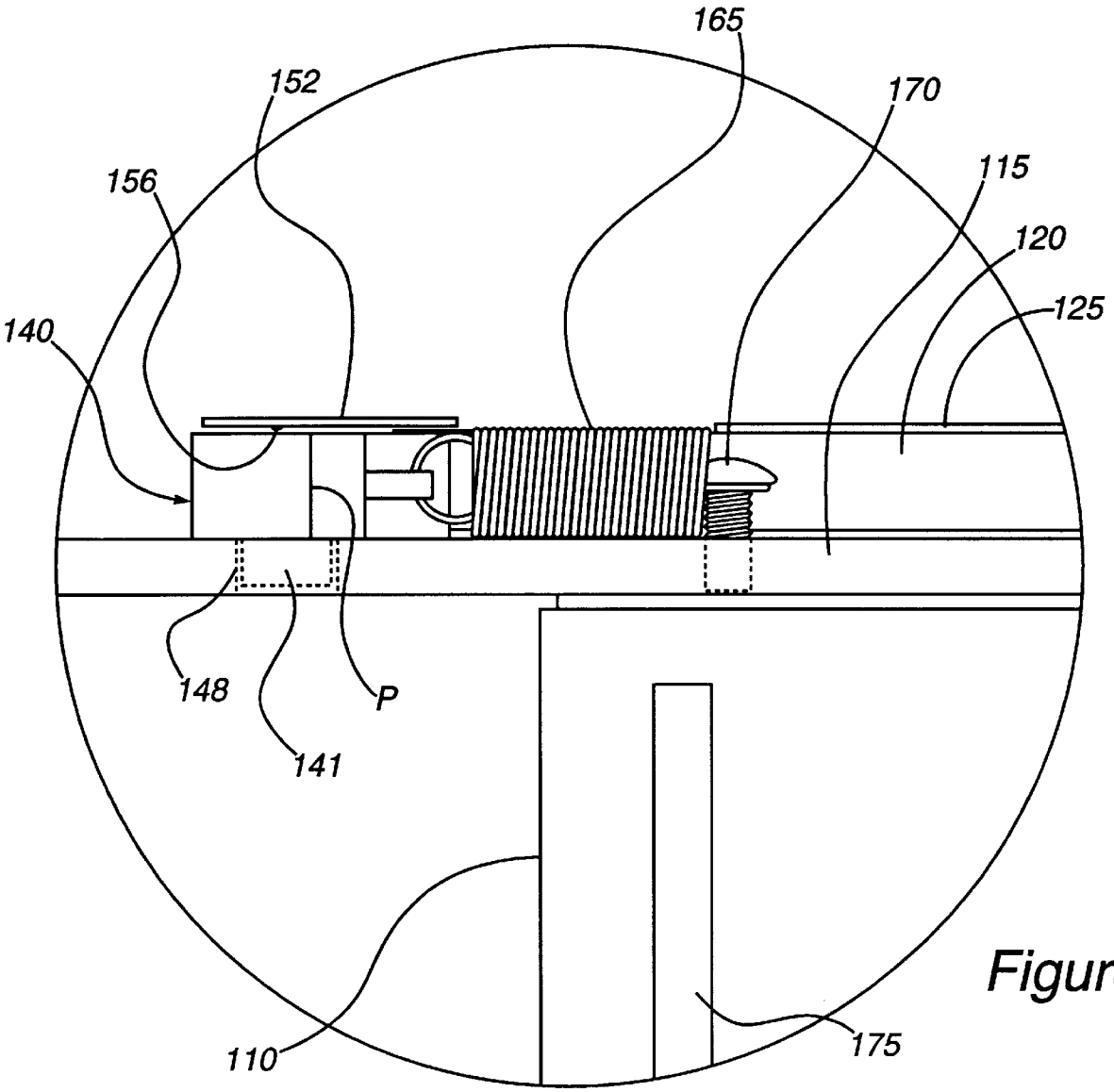
FIG. 1D illustrates an enlarged side view of the pawl clip assembly of FIG. 1A through 1C, rotated 90° from the orientation of FIG. 1A.

As illustrated in FIGS. 1A through 1D, pawl clip 150 "captures" or maintains brake pawl 140 between pawl clip 150 and flange 115. Pawl clip 140 is preferably fabricated from a relatively thin piece resilient material such as spring metal. As best illustrated in FIGS. 1C and 1D, pawl clip 150 preferably comprises a generally flat flange attachment portion 151. Pawl clip 150 is preferably attached to flange 115 via an attachment member 160 (for example, a screw) which enters a passage 155 in flange attachment portion 151. Washers 158 may be used for appropriate spacing. Pawl clip 150 also preferably comprises a pawl capture portion 152 which is preferably generally flat. Flange attachment portion 151 and pawl capture portion 152 are preferably connected via an angled connection portion 153, resulting in pawl capture portion 152 being elevated upward relevant to flange attachment portion 151. Flange capture portion 152 is sufficiently elevated to pass over brake pawl 140 when pivot member 141 is seated in bore 148 and pivot clip 150 is attached to flange 115.

To minimize any effect upon the operation of pawl 140, frictional contact between pawl 140 and pawl clip 150 is preferably minimized. In that regard, a protrusion is preferably formed on the bottom of pawl capture portion 152 and cooperates the upper, generally flat surface of brake pawl 140 to pivotally capture brake pawl 140 between pawl clip 150 and first flange 115.

Upon attachment of pawl clip 150 to flange 115, protrusion 156 preferably contacts the upper surface of pawl 140 or is positioned slightly above the upper surface of pawl 140. As used herein, the terms "upper" or "upward" refer to an axial direction away from drum hub 110, while the terms "lower" or "downward" refer to an axial direction toward drum hub 110. Most preferably, protrusion 156 contacts the upper surface of pawl 140 but exerts minimal or substantially no downward or compressive force on pawl 140, thereby minimizing the frictional contact between pawl clip 150 and pawl 140 while capturing pawl 140 to flange 115.

As best illustrated in FIG. 1C, protrusion 156 is also preferably positioned away from the center of rotation C of pivot member 141, and toward engagement point P of pawl 140. Such positioning of protrusion 156 assists in preventing movement or rotation of pawl 140 out of a plane parallel to the plane defined by flange 115. Protrusion 156 is also preferably positioned such that during pivoting of pawl 140, protrusion remains in contact with the upper surface of pawl 140 and does not go beyond the outer edge thereof. Upon pivoting of pawl 140 to engage a ratchet brake plate 440 (as discussed below), stationary protrusion 156 "moves" across the upper surface of pawl 140 in much the same manner as a stylus across the surface of a phonographic record.

One end of a spring 165 is preferably attached to brake pawl 140 and the other end of spring 165 is preferably attached to flange 115 via attachment member 170. This spring assembly biases brake pawl 140 towards the center of subassembly 105.

As best illustrated in FIG. 1D, preferably no portion of the pawl assembly (for example, pivot member 241, screw 160 or screw 170) extends downward beyond the lower surface of flange 115, which could cause interference with the winding and unwinding of lifeline 212 around drum hub 110. Moreover, capture portion 152 preferably does not extend upward to an extent that results in contact of capture portion 152 with any other component of device 100. Such contact could result in an increase in frictional contact between protrusion 156 and pawl 140.

Figures 2A, 2B:
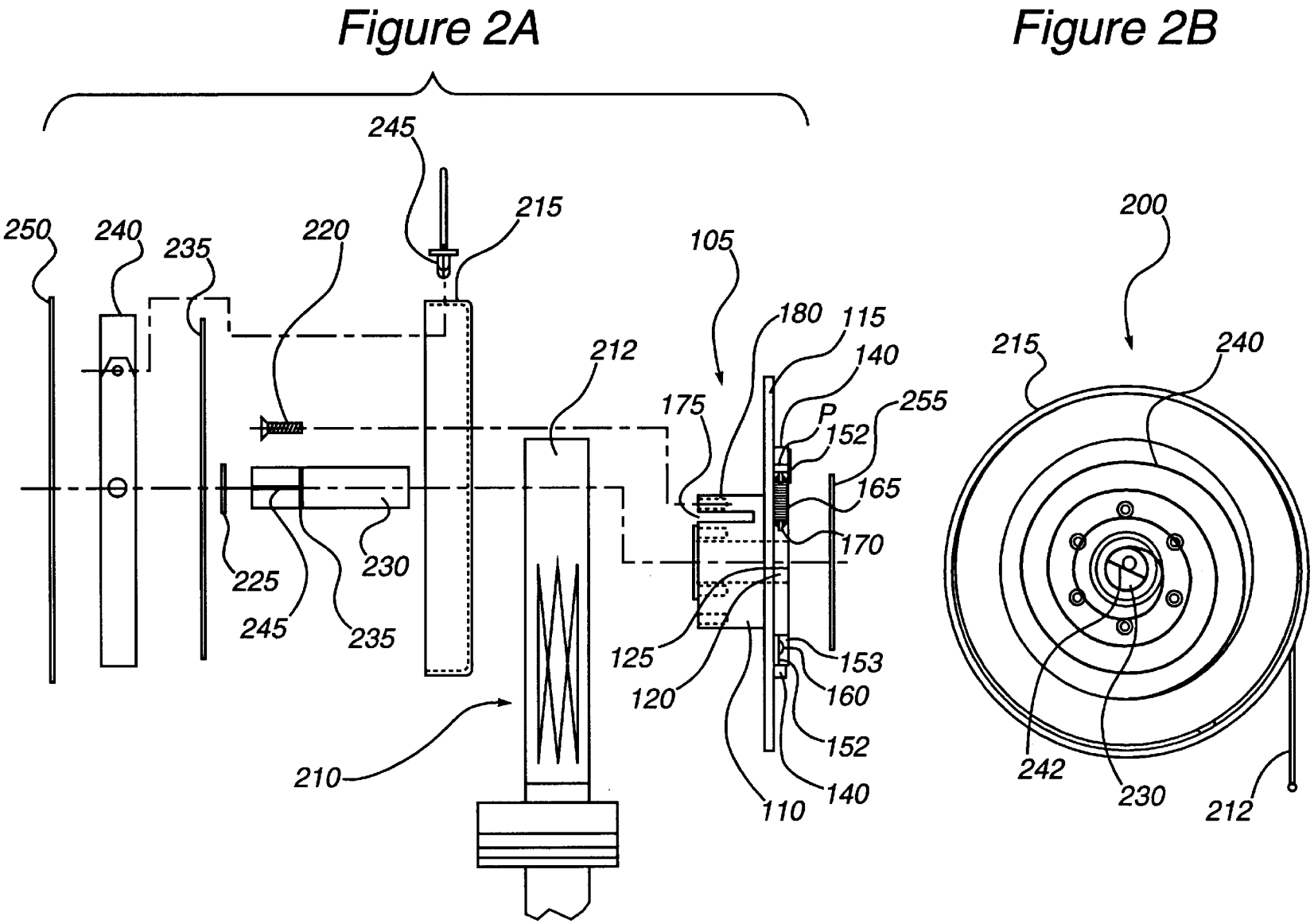
FIG. 2A illustrates schematically a side view of the components of an embodiment of a drum subassembly.
FIG. 2B illustrates a front view of the assembled drum subassembly of FIG. 2A.
Figure 7A:
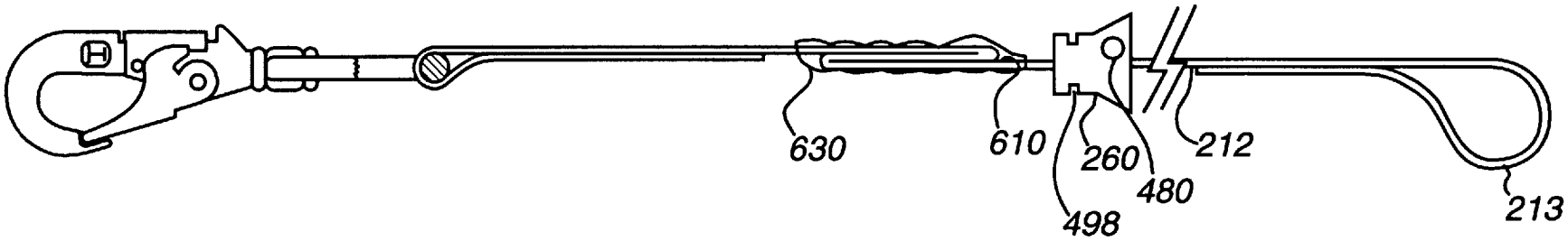
FIG. 7A illustrates a side view of an embodiment of a lifeline subassembly including an indicator for indicating when the lifeline has been exposed to a predetermined tensile load.
Figure 7B:
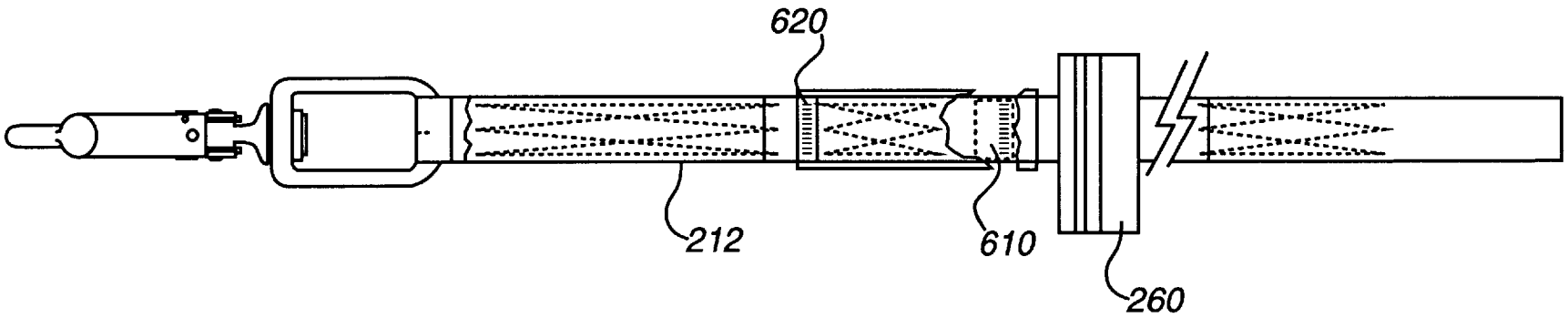
FIG. 7B illustrates a top, partially cut away, view of the lifeline of FIG. 7A.

FIGS. 2A and 2B illustrate the assembly of the components of drum subassembly 200. To partial drum subassembly 105 is attached a lifeline subassembly 210, comprising a lifeline 212. Preferably, a loop 213 (see FIG. 7A) in the end of lifeline 212 is passed through a slot 175 in drum hub 110 so that lifeline subassembly 210 does not rotate with respect to partial drum subassembly 105. A second drum flange 215 is attached to partial drum assembly 105 via attachment means (such as a screw 220 which cooperates with a threaded bore 180 in drum hub 110) and captures lifeline subassembly 210. As illustrated in FIG. 2A, second drum flange 215 preferably has a cup-shaped cross-section. A snap ring 225 is preferably slid over a mainshaft 230 (about which the drum subassembly rotates) to seat in a groove 235 and mainshaft 230 is inserted through a central passage 232 in a bearing member 234 centrally located in partial drum subassembly 105 until snap ring contacts partial drum subassembly 105. A first thrust pad 235 and then a spring 240 are slid into second drum flange 215 and around mainshaft 230. Thrust pads are preferably used to eliminate metal-to-metal contact, for example, between spring 240 and the drum, between the housing and the drum, and between spring 240 and the housing. Such thrust pads may, for example, be fabricated from relatively low-friction polymeric materials.

The center of spring 240 engages mainshaft 230. The end of spring 240 engaging mainshaft 230 is preferably formed with a relatively flat tab which protrudes through a slot 242 in mainshaft 230 to prevent spring 240 and mainshaft 230 from rotating relative to each other. The outer end of spring 240 is preferably attached to second drum flange 215 via spring attachment means 245.

Spring 240 is oriented such that when mainshaft 230 is fixed, spring 240 will bias second drum flange 215 (which is attached to partial drum assembly 105) in such a way as to retract lifeline subassembly 210 to wind lifeline 212 around drum hub 110. Lifeline 212 must be wound around drum hub 110 in such a way that when lifeline 212 is pulled to extend or unwind from drum hub 110 of partial drum subassembly 105, partial drum subassembly 105 rotates in the direction defined generally by point P of brake pawl 140 leading the round end of brake pawl 140. Second and third thrust pads 250 and 255 preferably slide over their respective ends of mainshaft 230 as illustrated in FIG. 2A.

Figure 3B:
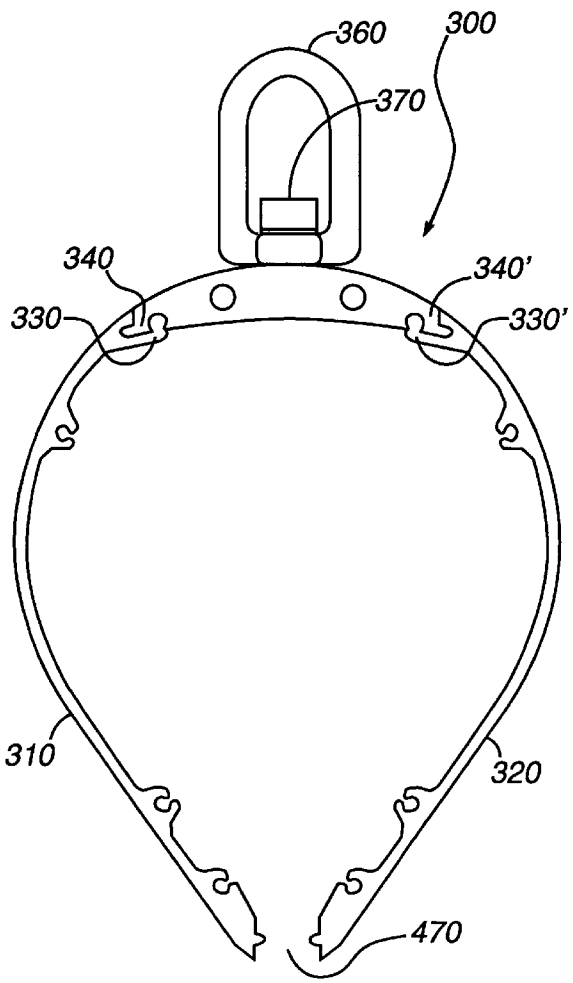
FIG. 3B illustrates a front view of the assembled housing subassembly of FIG. 3A.
Figure 3A:
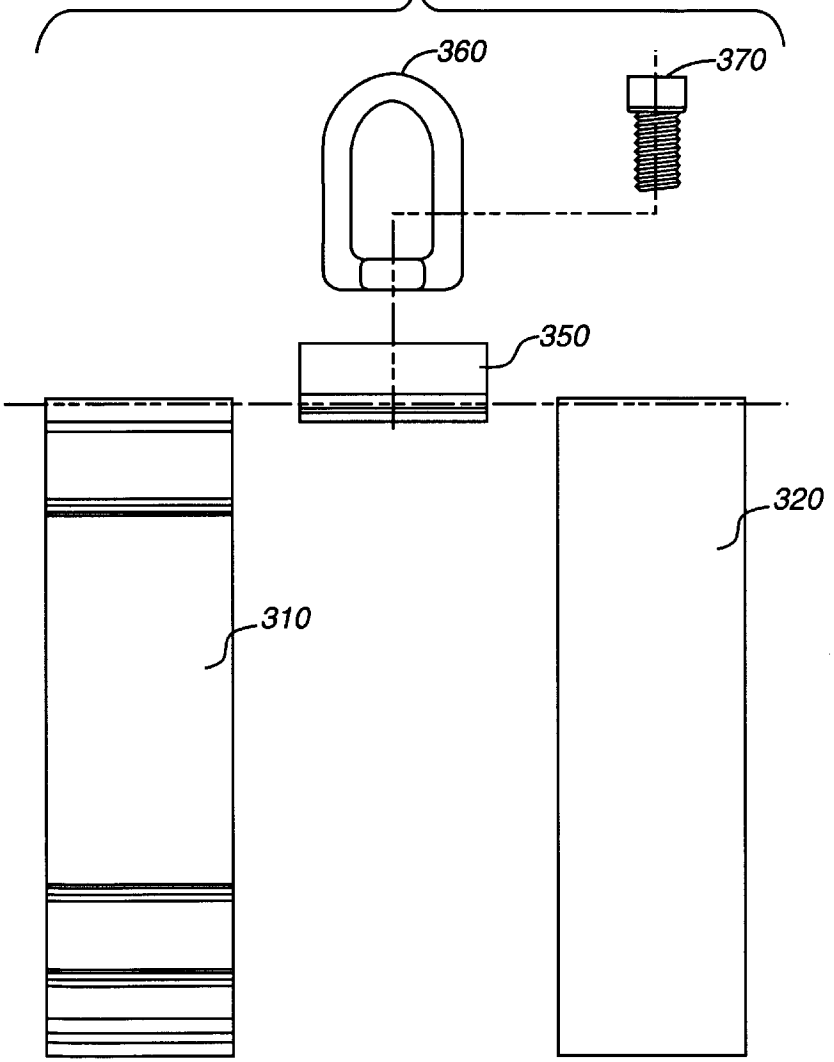
FIG. 3A illustrates a side view of the components of an embodiment of a housing subassembly.

FIGS. 3A and 3B illustrate the assembly of a housing subassembly 300. In the illustrated embodiment, housing subassembly 300 preferably comprises three extruded metal housing members. A first housing member 310 and a second housing member 320 are substantially identical. Each of housing members 310 and 320 includes, at a top end thereof, cooperating attachment means 330 and 330', respectively. Attachment means 330 and 330' cooperate with cooperating attachment means 340 and 340', respectively, formed upon the ends of a top housing member 350 to create an interlocking attachment between top housing member 350 and housing members 310 and 320. In the embodiment of FIGS. 3A and 3B, housing members 310, 350 and 320 are slid together to interlock via cooperating attachment means 330 and 330' and 340 and 340', respectively.

Means of attachment other than interlocking attachment means (for example, bolting) are possible to connect housing members 310, 350 and 320. Whatever type of attachment means are used, however, a dust seal is preferably created such that substantially no dust may enter the housing. Gaskets may be necessary to create a suitable dust seal with some attachment means (for example, bolting). In the case of interlocking attachment means 330, 340, 330' and 340', an interlocking connection of suitable tolerances is preferably formed such that a dust seal is created without the use of gaskets or other sealing means.

A swiveling loop 360, as known in the art, is preferably attached to top housing member 350 via a bolt 370. Bolt 370 may be permanently attached to top housing shell member 350.

FIGS. 4A and 4B illustrate the assembly of a rear cover and housing subassembly 400. A rear housing cover plate 410 is attached to the rear of housing subassembly 300 via screws 420 and 430 (preferably, self tapping screws) which cooperate with passages in housing subassembly 400. Rear housing cover plate 410 is preferably fabricated from stamped metal. Rear housing cover plate 410 includes on the interior side thereof a ratchet break plate 440. Ratchet brake plate 440 may, for example, be spot welded to rear housing cover 410. Ratchet brake plate 440 includes inwardly extending teeth 450 which cooperate with brake pawls 140 as known in the art. Ratchet brake plate 440 also preferably include abutment tabs 460 which cooperate with and abut housing subassembly 400 to ensure that ratchet brake plate 440 does not rotate with respect to housing subassembly 400.

Figure 6B:
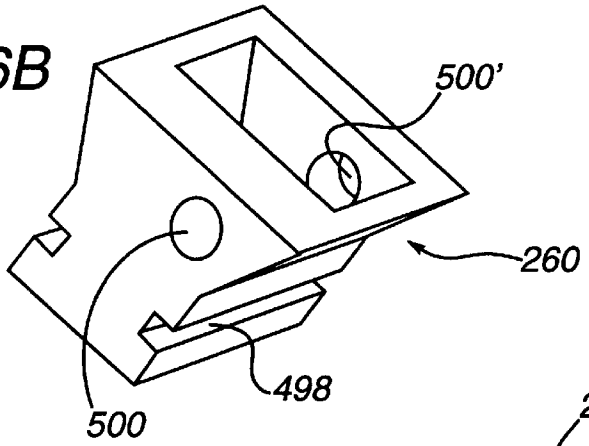
FIG. 6A through 6C illustrate an embodiment of an exit bushing member.
Figure 6C:
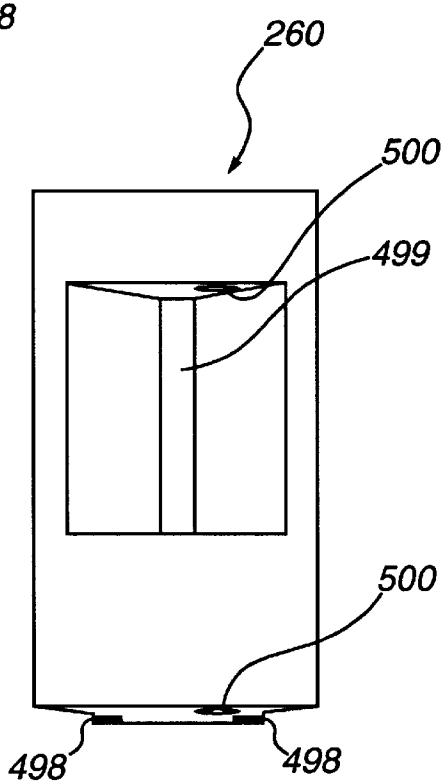
Figure 6A:
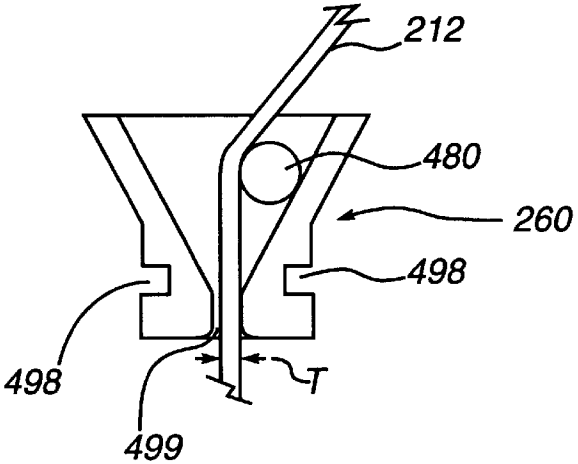

FIGS. 5A and 5B illustrate the final assembly of retractable lifeline safety device 100. During the assembly, drum subassembly 200 is inserted into rear cover and housing subassembly 400 in the direction indicated in FIG. 5A. An exit bushing member 260 (as best illustrated in FIGS. 6A through 6C) is slid into an appropriately shaped opening 470 at the bottom of rear cover and housing subassembly 400. In the embodiment illustrated in FIGS. 4B and 6A through 6C, subassembly 400 comprises projections 497 which cooperate with recesses 498 in exit bushing member 260 to firmly attach exit bushing member 260 to subassembly 400.

In the case of a webbing lifeline 212, roller member 480 is preferably placed in the housing near an opening 499 in entry bushing member 260 to decrease friction and to decrease abrasion of lifeline 212. In the embodiment illustrated in FIGS. 6A through 6C, roller member 480 is rotatably mounted in passages 500 and 500' formed in the sides of exit bushing member 260. Preferably, the width of exit bushing member opening 499 is less than approximately twice a thickness T of webbing lifeline 212 to assist in preventing uptake of twisted lifeline.

A housing front cover 485 is attached to drum subassembly 200 via a screw 490 which seats in mainshaft 230. Once attached, housing front cover 485 may be rotated to pretension spring 165 to a desired torque. Screws 492 and 494 (preferably self-tapping screws) cooperate with passages in housing subassembly 300 to attach front cover 485 to rear cover and housing subassembly 400. Front cover 485 is preferably fabricated from stamped metal. Screw 496 seats in mainshaft 230 and locks the other end of drum subassembly 200 to rear cover and housing subassembly 400.

Figure 8C:
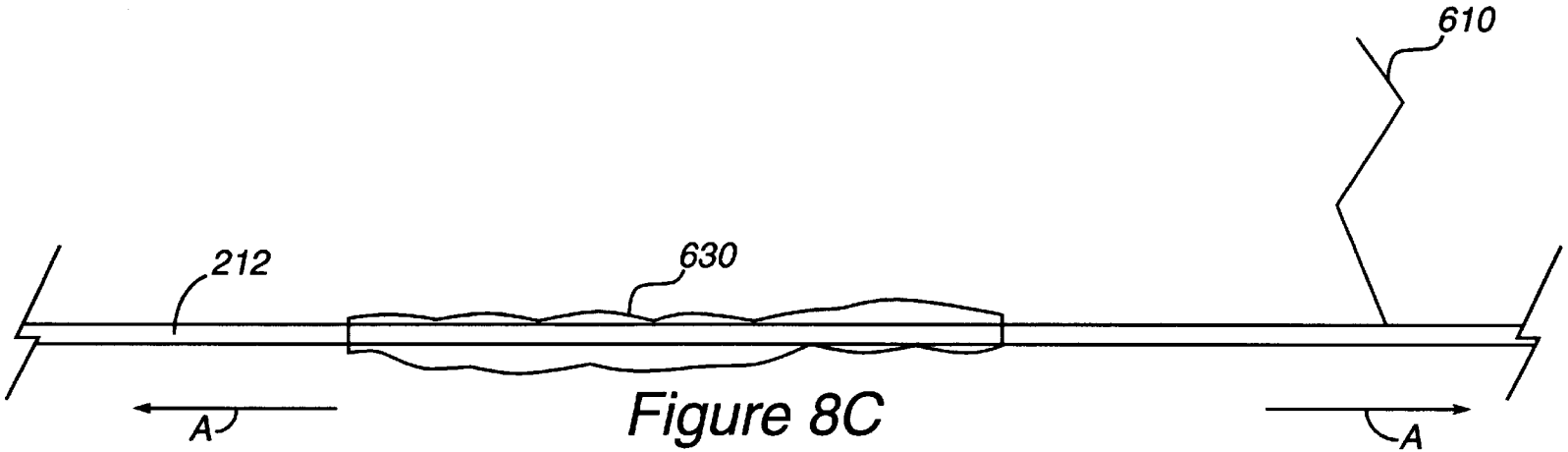
FIGS. 8A through 8C illustrate the release of a flag indicator upon exposure of the lifeline to a predetermined tensile load.
Figure 8B:
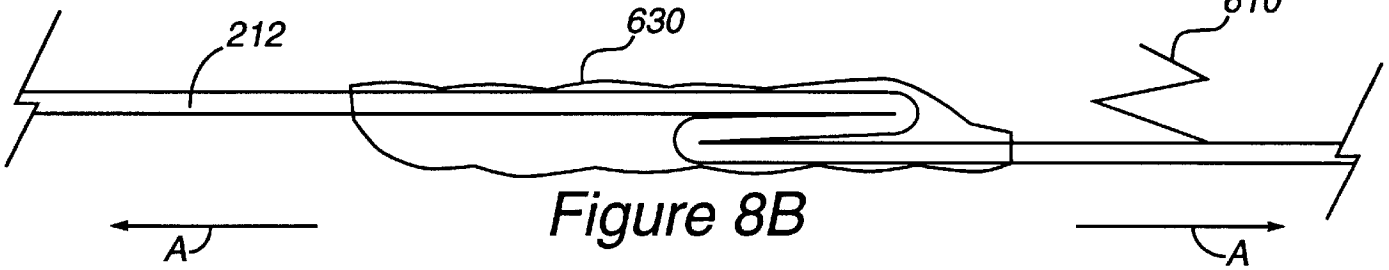
Figure 8A:
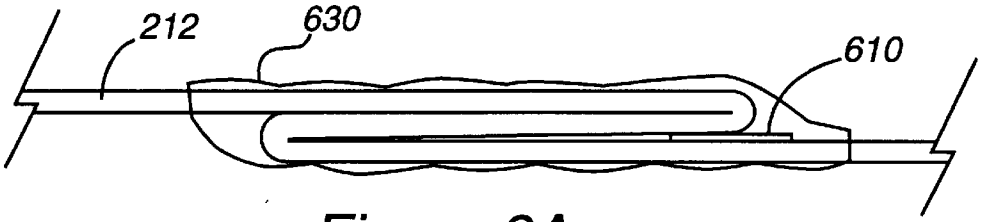

FIGS. 7A through 8C illustrated the construction and operation of a indicator means for indicating if lifeline 212 and device 100 have been subjected to a tensile load (represented by arrows A in FIGS. 8B and 8C) equal to or in excess of a predetermined tensile load. Preferably, the indicator means comprises a piece of material or flag 610 attached to lifeline 212 (for example, via sewing). Preferably, flag 610 is of sufficient dimensions that flag 610 is clearly visible to a user or an inspector when activated. Such a flag is discussed in U.S. Pat. No. 4,253,544, the disclosure of which is incorporated herein by reference. Flag 610 is preferably folded and a portion of lifeline 212 is then folded over folded flag 610. The folded portion of lifeline 212 is then fixed into a folded state (for example, via stitching 620) over flag 610. Stitching 620 is designed to separate upon predetermined tensile load A being applied to either end of lifeline 212 (for example, approximately 600 to 800 lbs). Upon experiencing a tensile load equal to or in excess of predetermined tensile load A, as illustrated in FIGS. 8B and 8C, stitching 620 becomes separated and the fold in lifeline 212 unfolds to release flag 610 to become clearly visible. The fold in lifeline 212 preferably has a protective covering 630 thereover, such as a plastic shrink, wrap, to protect the fold.

Although the present invention has been described in detail in connection with the above examples, it is to be understood that such detail is solely for that purpose and that variations can be made by those skilled in the art without departing from the spirit of the invention except as it may be limited by the following claims.

What is claimed is:

1. A safety device for restraining an individual exposed to a risk of falling, the safety device comprising:

a. a housing;

b. a drum assembly rotatably mounted within the housing, the drum assembly comprising:

i. a first drum flange;

ii. a second drum flange spaced generally parallel from the first drum flange; and iii. a drum hub centrally connected between the first drum flange and the second drum flange;

the safety device further comprising:

c. a lifeline having a first end attached to the drum hub and a second end extending outside the housing and adapted to be connected to an article outside the housing, the lifeline being wound around the drum hub when the drum hub is rotated in a retracting direction, and the lifeline being unwound from around the drum hub when the drum hub is rotated in an extending direction opposite the retracting direction;

d. a drum biasing mechanism to bias the drum hub to rotate in the retracting direction; and e. a brake mechanism to brake extending rotation of the drum hub upon the extending rotation reaching a predetermined angular velocity, the brake mechanism comprising:

i. a ratchet brake assembly fixed within the housing;

ii. at least one pawl pivotally mounted on and substantially parallel to the first drum flange, the pawl being pivotal into engagement with the ratchet brake assembly in response to the predetermined angular velocity, the brake mechanism further comprising a pawl clip to maintain the pawl adjacent to and substantially parallel to the first drum flange, the pawl clip being attached to the first drum flange on the same side thereof upon which the pawl is pivotally mounted; and iii. a pawl biasing mechanism to bias the pawl out of engagement with the ratchet brake assembly when the angular velocity is less than the predetermined angular velocity.

2. The safety device of claim 1 wherein the pawl clip comprises a protrusion extending therefrom to contact the pawl.

3. The safety device of claim 2 wherein the pawl comprises a generally cylindrical pivot member which extends into a bore in the first drum flange, the pawl pivoting about a center of rotation of the pivot member, the protrusion contacting the pawl at a point away from the center of rotation of the pivot member and towards an engagement point of the pawl at which the pawl engages the ratchet brake assembly.

4. The safety device of claim 2 wherein the force exerted by the protrusion on the pawl is maintained relatively small to reduce friction between the pawl clip and the pawl.

5. The safety device of claim 1 wherein no part of the brake mechanism connecting the brake mechanism means to the first drum flange extends through the first drum flange to protrude through a side of first drum flange upon which the drum hub is connected.

6. The safety device of claim 1 wherein the ratchet brake assembly comprises abutment members extending in a radially outward direction therefrom, the abutment members cooperating with the housing to prevent rotation of the ratchet brake assembly with respect to the housing.

7. A lifeline for use in a retractable lifeline safety device, the lifeline having a rectangular cross-section, the lifeline comprising an indicator flag attached thereto, a portion of the lifeline being folded over the indicator flag to create a fold therein such that the indicator flag is not visible, the fold in the lifeline being attached in the folded position by at least one fold attachment that detaches when the lifeline is subjected to a predetermined tensile load, at least a portion of the indicator flag becoming freed and visible when the fold attachment detaches.

8. The lifeline of claim 7 wherein the indicator flag is folded before the lifeline is folded thereover.

9. The lifeline of claim 7 further comprising a protective barrier substantially surrounding the fold in the lifeline.

10. The lifeline of claim 9 wherein the protective barrier comprises a shrink wrap.

* * * * *